United States Patent [19]

Nakanishi

[11] Patent Number: 4,662,623

[45] Date of Patent: May 5, 1987

[54] CASH CARTRIDGE WITH RATCHETED LOCKING MECHANISM

[75] Inventor: Tomoyuki Nakanishi, Moriyama, Japan

[73] Assignee: Omron Tateisi Electronics Co., Kyoto, Japan

[21] Appl. No.: 647,176

[22] Filed: Sep. 4, 1984

[30] Foreign Application Priority Data

Sep. 2, 1983 [JP] Japan ..... 58-136947

[51] Int. Cl.[4] ..... B65H 1/02

[52] U.S. Cl. ..... 271/150; 271/126; 271/157; 271/160

[58] Field of Search ..... 271/126, 150, 157, 160

[56] References Cited

U.S. PATENT DOCUMENTS 4,049,257 9/1977 Frystak ..... 271/160 X

FOREIGN PATENT DOCUMENTS 119636 9/1980 Japan ..... 271/157
70240 6/1981 Japan ..... 271/157
135040 8/1983 Japan ..... 271/157

*Primary Examiner*—Richard A. Schacher
*Attorney, Agent, or Firm*—Stevens, Davis, Miller & Mosher

[57] ABSTRACT

A cash cartridge for a cash processing machine includes: a pressure plate for biasing a stack of bank notes in a particular direction towards a cash outlet and for squeezing the stack of bank notes together; a pair of pulleys; an endless belt mounted on the pair of pulleys, with the pressure plate being fixedly mounted to the endless belt and being moved in the particular direction by rotation of the endless belt and the pair of pulleys in a certain particular rotational direction; a means for biasing the endless belt and the pair of pulleys in that particular rotational direction; a door which is opened for charging bank notes into the cash cartridge and is otherwise closed; and a means for preventing the endless belt and the pair of pulleys from rotating in the opposite rotational direction and for allowing them to rotate in the particular rotational direction when the door is closed, and for allowing the endless belt and the pair of pulleys to rotate in either rotational direction when the door is open. Thereby, when the door is open, the pressure plate can be easily moved back so as to recharge the cash cartridge with bank notes, while, when the door is closed, the pressure plate can only move in the direction to compress the stack of bank notes but not in the reverse direction, thus making transport of the charged cash cartridge without disturbing the bank notes charged therein practicable.

4 Claims, 3 Drawing Figures

CASH CARTRIDGE WITH RATCHETED LOCKING MECHANISM

BACKGROUND OF THE INVENTION

The present invention relates to a cash cartridge for being detachably charged into a cash handling machine such as an automatic bank note dispenser, and in particular to such a cash cartridge which incorporates a novel and convenient mechanism for preventing bank notes charged therein from becoming disarranged during transport of the cash cartridge.

Cash handling machines such as automatic bank note dispensers typically are recharged with fresh bank notes by a detachable cash cartridge which is fitted into them. Such a cash cartridge can conveniently be removed from the cash dispenser for being charged with a fresh supply of bank notes, and can then be simply attached to the cash dispenser to provide a supply of bank notes thereto.

For reasons of security and of convenience of counting and arranging, it is desirable for such a cash cartridge to be recharged with a fresh supply of bank notes at a location at least somewhat remote from the location of the cash dispenser to which the cash cartridge will be fitted. For example, in a banking network, it is convenient to recharge the cash cartridges for all the cash dispensers in a particular are at a central bank note counting and recharging station. This provision of a central recharging station is convenient, not only because such a recharging station is required to have available a relatively large amount of bank notes, but also because these bank notes need to be accurately counted and to be accurately stacked together in neat blocks, before being charged into the cash cartridges, and this stacking is a delicate and time consuming operation. Further, the counting of the bank notes and the stacking thereof may conveniently be done by machine, and in such a case it is obviously convenient to perform the counting and recharging in a central charging station, in view of economy of machine utilization.

The problem then arises as to how the stack of bank notes charged into such a cash cartridge is to be kept in the properly stacked and neatly arranged condition in the cash cartridge, while the cash cartridge is being transported to the cash dispenser or other cash handling machine into which it is to be fitted. If during such transport the stack of bank notes in the cash cartridge becomes disarranged or disorganized, and its accurate stacking is lost, then the operation of the cash dispenser will likely be erroneous, and various problem can arise, such as jamming of the cash dispenser, or even in the worst case inaccurate distribution of bank notes to customers.

Now, for biasing the stack of bank notes in the cash cartridge when the cash cartridge is fitted to the cash dispenser, it is common to provide a pressure plate, which is biased towards the stack of bank notes and compresses them and also biases the stack as a whole in a particular direction, typically the direction of a take out roller or rollers for removing the bank notes one at a time from the stack into the interior works of the cash dispenser. Therefore, it is known to provide a means for locking the movement of this pressure plate, which is automatically unlocked to allow movement of the pressure plate when the cash cartridge is fitted to the cash dispenser. The movement of the pressure plate also of course must be unlocked during recharging of the cash cartridge with a fresh stack of bank notes, and accordingly such a mechanism is has the problem that it is complicated and expensive. Further, the cost of a cash cartridge incorporating such a mechanism is high.

SUMMARY OF THE INVENTION

Accordingly, it is the primary object of the present invention to provide a cash cartridge which avoids the above outlined problems of the prior art.

It is a further object of the present invention to provide a cash cartridge, which does not require that a locking mechanism for a pressure plate therein be released when the cash cartridge is fitted to a cash dispenser.

It is a further object of the present invention to provide a cash cartridge, which is not subject to any problems of bank note disarrangement when, after having been charged with a fresh stack of bank notes, it is being transported towards a cash dispenser.

It is a yet further object of the present invention to provide such a cash cartridge, which has a simplified structure.

It is a yet further object of the present invention to provide such a cash cartridge, which is light.

It is a yet further object of the present invention to provide such a cash cartridge, which is inexpensive.

It is a yet further object of the present invention to provide such a cash cartridge, from which cash can be transferred into a cash dispenser to which it is fitted in an appropriately smooth manner.

It is a yet further object of the present invention to provide such a cash cartridge, which keeps the risk of jamming of a cash dispenser to which it is fitted low.

It is a yet further object of the present invention to provide such a cash cartridge, which keeps the risk of improper operation of a cash dispenser to which it is fitted low.

It is a yet further object of the present invention to provide such a cash cartridge, which keeps the risk of improper delivery of money to a customer of a cash dispenser to which it is fitted as low as possible.

According to the most general aspect of the present invention, these and other objects are accomplished by a cash cartridge for a cash processing machine, comprising: (a) a pressure plate for biasing a stack of bank notes in a particular direction towards a cash outlet and for squeezing the stack of bank notes together; (b) a pair of pulleys; (c) an endless belt mounted on the pair of pulleys, the pressure plate being fixedly mounted to the endless belt and being moved in the particular direction by rotation of the endless belt and the pair of pulleys in a certain particular rotational direction; (d) a means for biasing the endless belt and the pair of pulleys in the particular rotational direction; (e) a door which is opened for charging bank notes into the cash cartridge and is otherwise closed; and (f) a means for preventing the endless belt and the pair of pulleys from rotating in the rotational direction opposite to the particular rotational direction and allowing them to rotate in the particular rotational direction when the door is closed, and for allowing the endless belt and the pair of pulleys to rotate in either rotational direction when the door is open.

According to such a structure, when it is desired to recharge the cash cartridge with a fresh stack of bank notes, then the door is opened, and at this time automatically the means (f) allows the endless belt and the pair of pulleys to rotate in either rotational direction, in particular in the rotational direction opposite to the particular rotational direction, so that the pressure plate can freely be moved backwards in the direction opposite to the particular direction against the biasing action of the biasing means (d), so as to obtain room for placing the stack of bank notes into the cash cartridge. Then, after the stack of bank notes is fitted into the cash cartridge and has been snugly and neatly arranged therein with its stacking accurate, the door is closed, and thereafter the means (f) automatically prevents the endless belt and the pair of pulleys from rotating in the rotational direction opposite to the particular rotational direction, while still allowing them to rotate in the particular rotational direction. Thereby, when the cash cartridge is being transported to a particular machine such as a cash dispenser to which it is to be fitted, even if the cash cartridge is considerably shaken about and even perhaps inverted, since the pressure plate is by the action of the means (f) no longer allowed to be moved backwards in the direction opposite to the particular direction against the biasing action of the biasing means (d), even by the inertia of the perhaps quite heavy weight of the fresh stack of bank notes which would easily be enough to overcome the biasing action of the biasing means (d) if that were the sole opposing force, therby it is prevented that the compression of the bank note stack by the biasing means (d) should be at all relieved. Accordingly, this cash cartridge is not subject to any problems of bank note disarrangement when, after having been charged with a fresh stack of bank notes, it is being transported towards a cash dispenser. Further, this action is provided, without any requirement that any locking mechanism for the pressure plate should be released when the cash cartridge is fitted to a cash dispenser. Accordingly, this cash cartridge has a simplified structure. Further, it is is light and inexpensive. And also this cash cartridge keeps the risk of jamming of a cash dispenser to which it is fitted low, and keeps the risk of improper operation of a cash dispenser to which it is fitted low. Accordingly, it also keeps the risk of improper delivery of money to a customer of a cash dispenser to which it is fitted as low as possible.

Further, according to more particular aspects of the present invention, these and other objects may be more particularly and concretely accomplished by such a cash cartridge as described above, wherein the rotation preventing means comprises a one way clutch mounted between the one of the pulleys and the shaft and allowing the pulley to rotate relative to the shaft in the particular rotational direction but not in the rotational direction opposite to the particular rotational direction, and a means for preventing the shaft from rotating when the door is closed, and for allowing the shaft to rotate in either rotational direction when the door is open; and in this case said means for prevention of shaft rotation may comprise a toothed wheel fixedly mounted to the shaft and a locking member, which is biased towards the toothed wheel so as to engage it by the door when it is closed, and which is biased away from the toothed wheel so as to be disengaged from it when the door is open. Alternatively, one of the pulleys may be fixedly mounted on a shaft, and the rotation preventing means may comprise a toothed wheel fixedly mounted to the shaft, a pawl which when biased towards the toothed wheel allows the pulley, the shaft, and the toothed wheel to rotate in the particular rotational direction but not in the rotational direction opposite to the particular rotational direction, a means for biasing the pawl away from the toothed wheel when the door is open, and a means for biasing the pawl towards the toothed wheel when the said door is closed. Either of these particular constructional alternatives may be preferable, depending upon circumstances.

BRIEF DESCRIPTION OF THE DRAWINGS

The present invention will now be shown and described with reference to the preferred embodiment thereof, and with reference to the illustrative drawings. It should be clearly understood, however, that the description of the embodiment, and the drawings, are all of them given purely for the purposes of explanation and exemplification only, and are not intended to be limitative of the scope of the present invention in any way, since the scope of the present invention is to be defined solely by the legitimate and proper scope of the appended claims. In the drawings:

DESCRIPTION OF THE PREFERRED EMBODIMENT

Figure 1:
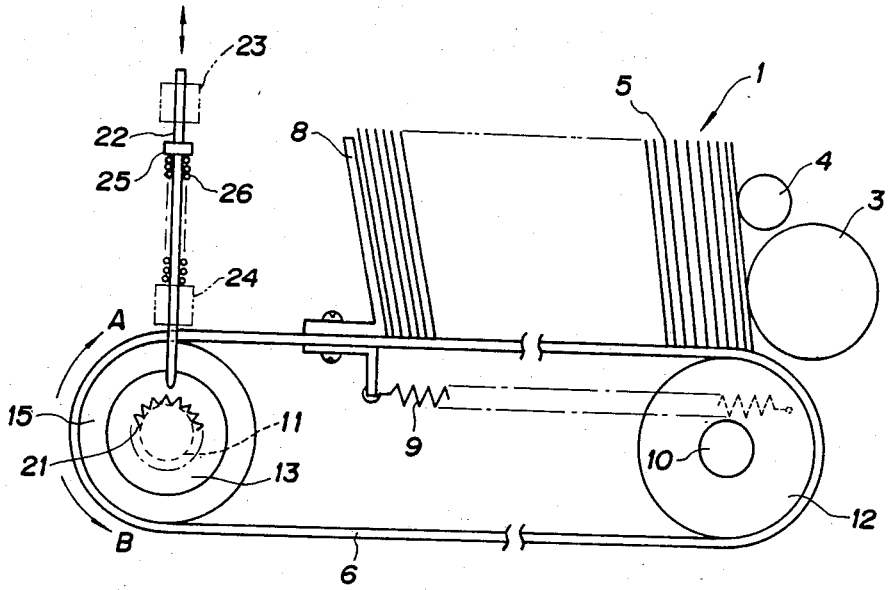
FIG. 1 is a schematic side view of the preferred embodiment of the cash cartridge with ratcheted locking mechanism according to the present invention.
Figure 2:
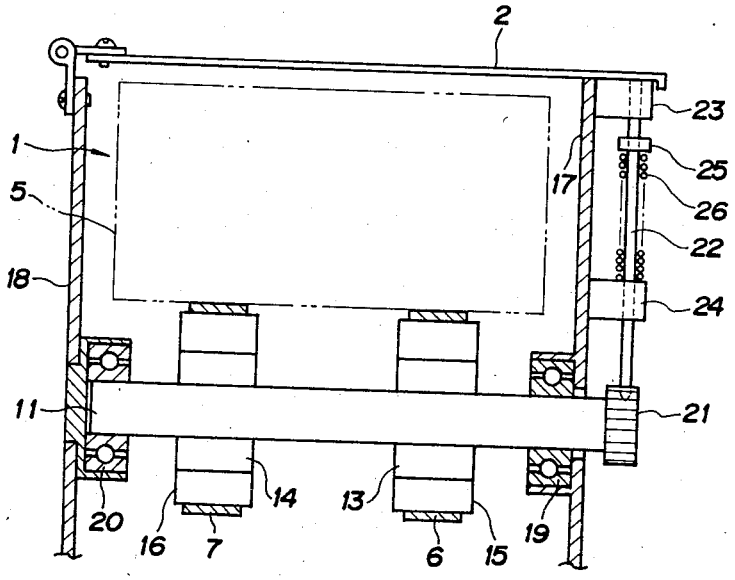
FIG. 2 is a schematic end view of said preferred embodiment of the present invention, as seen from the left side of FIG. 1 looking rightwards; and, FIG. 3 is a schematic side view of another embodiment of the invention.

The present invention will now be described with reference of the preferred embodiment thereof, and with reference to the appended drawings. FIG. 1 is a schematic side view of this preferred embodiment of the cash cartridge of the present invention, and FIG. 2 is an end on view of the preferred embodiment as seen from the left of FIG. 1. In the figures, the main body of the cash cartridge is not shown, but it has two side frame plates 17 and 18 which are fixedly mounted in parallel to one another (plate 17 is to be considered as removed to give the view shown in FIG. 1, which is schematic). Between these side frame plates 17 and 18 there extend two parallel rotatable shafts 10 and 11: the shaft 11 is rotatably mounted to the plates 17 and 18 via bearings 19 and 20 respectively, and the shaft 10 is likewise rotatably mounted to the plates 17 and 18, but shaft 10 and its bearings cannot be seen in FIG. 2 because they lie directly behind the shaft 11 and the bearings 19 and 20 from the point of view of that figure. To the top edge from the point of view of the figures of the frame plate 18 there is pivotally fixed one edge of a cartridge lid 2 (not shown in FIG. 1), and this cartridge lid 2 is adapted either to be closed down so as to cover the top opening of the cash cartridge, as shown in FIG. 2, or to be pivoted in the counterclockwise direction from the point of view of that figure so as to open the top opening of said cash cartridge. Particularly it should be noted that cartridge lid 2 is only opened for charging bank notes into the cash cartridge, and is otherwise closed: the cartridge lid 2 is not required to be opened, and is definitely kept closed, when the cash cartridge is fitted to a cash processing device such as a cash dispenser or the like for supplying bank notes thereto. On the rotatable shaft 10 there are mounted two pulleys 15 and 16, and correspondingly on the rotatable shaft 11 there are mounted two other pulleys: a pulley 12, and a nameless pulley not shown in the figures because it lies behind the pulley 12 from the point of view of FIG. 1 and behind the pulley 16 from the point of view of FIG. 2. Around the puleys 15 and 12 there is fitted an endless belt 6, and a similar endless belt 7 is fitted parallel to belt 6 around the pulley 16 and the aforesaid nameless pulley. To the upper sides of the top runs of the belts 6 and 7 there is fixedly secured a pressure plate 8, extending parallel to the shafts 10 and 11, and to the lower sides of these top runs of the belts 6 and 7, on the other side thereof from pressure plate 8 and juxtaposed thereto with the belts 6 and 7 between them, there is fixedly secured a lug, to which one end of a tension coil spring 9 is connected, the other end of the tension col spring 9 being secured to and pulling on a fixed portion of the frame of the cash cartridge, not shown. Thereby, the pressure plate is biased rightwards as seen in FIG. 1, with the belts 6 and 7 and the pulleys 12, 15, 16, and the nameless pulley being likewise biased in the clockwise direction in that figure.

During use of the cash cartridge, a stack 5 of bank notes is placed on the top surfaces of the belts 6 and 7, lying across them as seen in FIG. 1, with the pressure plate 8 compressing stack 5 and biasing all the bank notes therein in the rightward direction in FIG. 1 under the action of the tension coil spring 9. Thus, the stack 5 of bank notes is biased against a take out roller 3 and an auxiliary roller 4 (which are parallel to the shafts 10 and 11) with a certain force, and, when these rollers 3 and 4 are rotated in the clockwise direction as seen in FIG. 1, the rightmost one of the stack 5 of bank notes can be lifted away from the stack and fed upwards as seen in the figure, out from the cash cartridge through an outlet slot which is not shown in the figures into the innards of a cash processing device such as a cash dispenser or the like to which this cash cartridge is fitted. Thereby the notes of the stack 5 can be taken out of the cash cartridge one by one in a controlled fashion.

Now, the pulley 12 for the endless belt 6 and the corresponding nameless pulley for the endless belt 7 are fixedly secured to the shaft 10, which is free to rotate with respect to the side frame plates 17 and 18 and with respect to the body of the cash cartridge at all times. However, the pulley 15 for the endless belt 6 and the corresponding pulley 16 for the endless belt 7 are secured to the shaft 11 via one way clutches 13 and 14 respectively, which allow pulleys 15 and 16 to rotate freely in the clockwise direction as seen in FIG. 1 relative to said shaft 11 but prevent said pulleys 15 and 16 from rotating in the anticlockwise direction in said figure relative to said shaft 11. And the shaft 11 is selectively either rotationally fixed to the frame of the cash cartridge or is freed to rotate with respect thereto by a locking construction which will now be described. On the right hand end as seen in FIG. 2 of the shaft 11, which projects to the outside of the side frame plate 17, there is fixedly mounted a toothed wheel 21, and to the side frame plate 17 there are mounted above one another and vertically spaced apart two fixed lugs 23 and 24 with coaxial holes formed in them. A rod 22 with a pointed lower end slides in these lugs 23 and 24, and has a fixed lug 25 mounted on it between the lugs 23 and 24, with a compression coil spring 26 being fitted over the rod between its lug 25 and the lower lug 24, so that this compression coil spring 26 biases the rod 22 in the upwards direction in the figures. When the cartridge lid 2 is opened up, then the rod 22 is allowed to move under the biasing action of the compression coil spring 26 to its upwards position as seen in FIG. 1, and then its upper end projects somewhat out above the upper lug 23, while its lower end is disengaged from the toothed wheel 21 fixed on the shaft 11, and in this condition of the apparatus the toothed wheel 21 and the shaft 11 are allowed to rotate freely relative to the frame of the cash cartridge. On the other hand, when the cartridge lid 2 is closed down as shown in FIG. 2, then the rod 22 is pushed down against the biasing action of the compression coil spring 26 which is overcome to its downwards position as seen in FIG. 2, and then its upper end is brought flush to the upper surface of the upper lug 23, while its lower end is caused to be engaged between the teeth of the toothed wheel 21, and in this condition of the apparatus the toothed wheel 21 and the shaft 11 are fixed relative to the frame of the cash cartridge and are not allowed to rotate with respect thereto.

Figure 3:
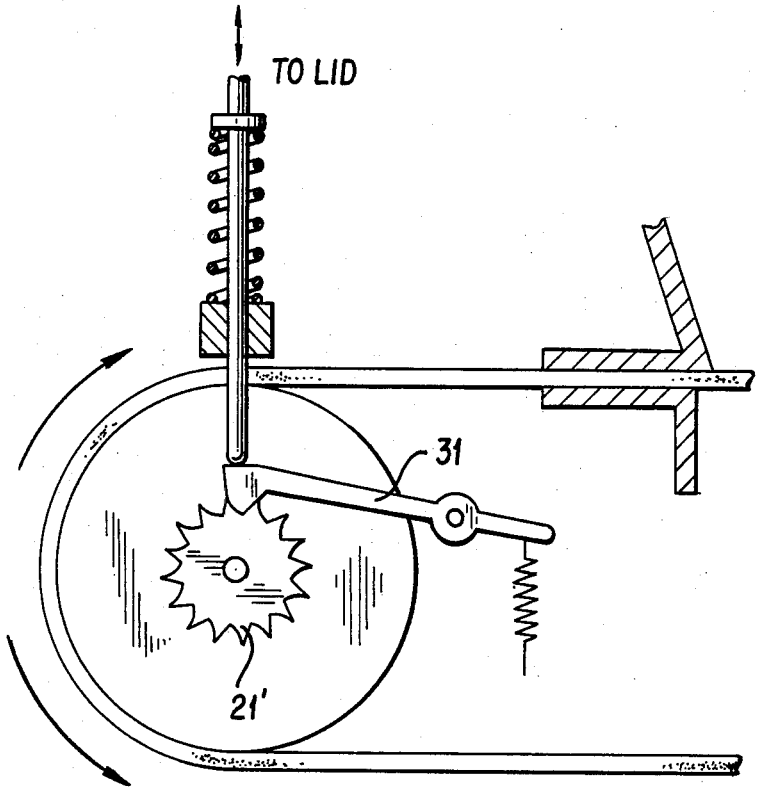

An alternative construction which would accomplish the same ends would be for the one way clutches 13 and 14 to be omitted, and, as shown in FIG. 3, for the toothed wheel 21 to be replaced by a ratchet wheel 21, with the rod 22 replaced by a pawl 31 which, when thus engaged to said ratchet wheel when the cartridge lid was pivoted downwards to close the top of the cash cartridge, allowed the pawl and the shaft 11 only to rotate in the clockwise direction as seen in FIG. 1 and not in the anticlockwise direction.

This cash cartridge operates as follows. When the cash cartridge is to be recharged with an additional supply of bank notes, then it is removed from its cash processing device such as a cash dispenser or the like, and the cartridge lid 2 is opened up. When this is done, then the rod 22 is allowed to move under the biasing action of the compression coil spring 26 to its upwards position as seen in FIG. 1, so that its lower end becomes disengaged from the toothed wheel 21 fixed on the shaft 11, and thus as described previously the toothed wheel 21 and the shaft 11 are allowed to rotate freely relative to the frame of the cash cartridge. Thereby, it is possible for the operator to pull the pressure plate 8 back against the biasing action of the tension coil spring 9 leftwards in FIG. 1, thus rotating the endless belts 6 and 7 and the pulleys 12, 15, 16, and the nameless pulley counterclockwise as seen in that figure (in the direction of the arrow B), and thus the operator can easily insert a new slab 5 of bank notes into the cash cartridge on the right side in FIG. 1 of the pressure plate 8, and can without difficulty square up and arrange the slab 5 of bank notes; and further the operator can then allow the pressure plate 8 to compress and squeeze together this slab or stack 5 of bank notes, under the biasing action of the compression coil spring 9. Next, after thus recharging the cash cartridge, the operator closes the cartridge lid 2, and as described above this causes the lid 2 to push the rod 22 down against the biasing action of the compression coil spring 26 which is overcome to its downwards position as seen in FIG. 2, so that its upper end is brought flush to the upper surface of the upper lug 23 and so that its lower end is caused to be engaged between the teeth of the tooth wheel 21, and this locks the toothed wheel 21 and the shaft 11 so as to make them be fixed relative to the frame of the cash cartridge. In this condition of the apparatus, the endless belts 6 and 7 and the pulleys 12, 15, 16, and the nameless pulley can be rotated clockwise as seen in FIG. 1 (in the direction of the arrow A) due to the action of the one way clutches 13 and 14, but cannot be rotated in the reverse direction (of the arrow B), and therefore the pressure plate 8 can only be moved in the rightwards direction in FIG. 1 so as to increase the pressure on the stack 5 of bank notes, and cannot be moved in the leftwards direction in that figure so as to relieve the squeezing pressure. Hence, by this positive maintenance of the squeezing of the bank note stack 5, by a force which is much greater in pricniple than the biasing force of the compression coil spring 9 since the pressure plate 8 cannot be moved leftwards at all, the cash cartridge may be freely carried around and even inverted, without any danger that this motion will cause the position of the stored bank notes to be disturbed. Further, when this cash cartridge is charged into and fitted to its cash processing device such as a cash dispenser or the like, with the cartridge lid 2 particularly left closed, then because the stored stack of bank notes 5 is kept pressured against the take out roller 3 and the auxiliary roller 4 by the force of the tension coil spring 9 as described above, the delivery of the bank notes may be made in a smooth and controlled manner. And, because it is not necessary to provide any device for unlocking the rotation of the shaft 11 or the like at the time that the cash cartridge is fitted to the cash processing machine, thereby the structure of the device is simplified.

According to the above described structure for the cash cartridge, therefore, when it is desired to recharge the cash cartridge with a fresh stack of bank notes, then the door 2 is opened, and at this time automatically the means including the rod 22 and the toothed wheel 21 and so on allows the endless belts 6 and 7 and the two pairs of pulleys 12, 15, 16, etc., to rotate in either rotational direction, in particular in the rotational direction shown by the arrow B in FIG. 1, so that the pressure plate 8 can freely be moved backwards in the leftwards direction in the figure against the biasing action of the tension coil spring 9, so as to obtain room for placing a new stack 5 of bank notes into the cash cartridge. Then, after the stack of bank notes is fitted into the cash cartridge and has been snugly and neatly arranged therein with its stacking accurate, the door is closed, and thereafter the means including the rod 22 and the toothed wheel 21 and so on automatically prevents said endless belts 6 and 7 and the two pairs of pulleys 12, 15, 16, etc., from rotating in the rotational direction shown by the arrow B in FIG. 1, while still allowing them to rotate in the rotational direction shown by the arrow A. Thereby, when the cash cartridge is being transported to a particular machine such as a cash dispenser to which it is to be fitted, even if the cash cartridge is considerable shaken about and even perhaps inverted, since the pressure plate 8 is by the action of the means including the rod 22 and the toothed wheel 21 and so on no longer allowed to be moved leftwards as seen in FIG. 1 against the biasing action of the tension coil spring 9, even by the inertia of the perhaps quite heavy weight of the fresh stack of bank notes which would easily be enough to overcome the biasing action of the tension coil spring 9 if that were the sole opposing force, thereby it is prevented that the compression of the bank note stack by the tension coil spring 9 should be at all relieved. Accordingly, this cash cartridge is not subject to any problems of bank note disarrangement when, after having been charged with a fresh stack of bank notes, it is being transported towards a cash dispenser. Further, this action is provided, without any requirement that any locking mechanism for the pressure plate 8 should be released when the cash cartridge is fitted to a cash dispenser. Accordingly, this cash cartridge has a simplified structure. Further, it is is light and inexpensive. And also this cash cartridge keeps the risk of jamming of a cash dispenser to which it is fitted low, and keeps the risk of improper operation of a cash dispenser to which it is fitted low. Accordingly, it also keeps the risk of improper delivery of money to a customer of a cash dispenser to which it is fitted as low as possible.

Although the present invention has been shown and described with reference to the preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. For example, the alternative construction outlined above including a pawl is also a viable possible variation for the present invention. Therefore it is desired that the scope of the present invention, and of the protection sought to be granted by Letters Patent, should be defined not by any of the perhaps purely fortuitous details of the shown preferred embodiment, or of the drawings, but solely by the scope of the appended claims, which follow.

What is claimed is:

1. A cash cartridge for a cash processing machine, comprising:

(a) a pressure plate for biasing a stack of bank notes in a particular direction towards a cash outlet and for squeezing said stack of bank notes together;

(b) a pair of pulleys;

(c) an endless belt mounted on said pair of pulleys, said pressure plate being fixedly mounted to said endless belt and being moved in said particular direction by rotation of said endless belt and said pair of pulleys in a certain particular rotational direction;

(d) a means for biasing said endless belt and said pair of pulleys in said particular rotational direction;

(e) a door which is opened for charging bank notes into the cash cartridge and is otherwise closed; and (f) a means for preventing said endless belt and said pair of pulleys from rotating in the rotational direction opposite to said particular rotational direction and allowing them to rotate in said particular rotational direction when said door is closed, and for allowing said endless belt and said pair of pulleys to rotate in either rotational direction when said door is open.

2. A cash cartridge for a cash processing machine, according to claim 1, one of said pulley being rotatably mounted on a shaft, wherein said rotation preventing means comprises a one way clutch mounted between said one of said pulleys and said shaft and allowing said pulley to rotate relative to said shaft in said particular rotational direction but not in the rotational direction opposite to said particular rotational direction, and a means for preventing said shaft from rotating when said door is closed, and for allowing said shaft to rotate in either rotational direction when said door is open.

3. A cash cartridge for a cash processing machine, according to claim 2, wherein said means for preventing of shaft rotation comprises a toothed wheel fixedly mounted to said shaft and a locking member, which is biased towards said toothed wheel so as to engage it by said door when it is closed, and which is biased away from said toothed wheel so as to be disengaged from it when said door is opened.

4. A cash cartridge for a cash processing machine, according to claim 1, wherein one of said pulleys is fixedly mounted on a shaft, and said rotation preventing means comprises a ratchet wheel fixedly mounted to said shaft, a pawl which when biased towards said ratchet wheel allows said pulley, said shaft, and said ratchet wheel to rotate in said particular rotational direction but not in the rotational direction opposite to said particular rotational direction, a means for biasing said pawl away from said ratchet wheel when said door is open, and a means for biasing said pawl towards and into contact with said ratchet wheel when said door is closed.

* * * * *